United States Patent [19]

Wisdom et al.

[11] 4,076,117

[45] Feb. 28, 1978

[54] SAFETY MATCH BOX

[76] Inventors: Trevor C. Wisdom, 14 University Place, Glen Head, N.Y. 11545; Leroy J. Wisdom, 148 Fifth Acre Road South, Smithtown, N.Y. 11787

[21] Appl. No.: 707,438

[22] Filed: Jul. 21, 1976

[51] Int. Cl.[2] ..... A24F 27/00; B65D 13/06

[52] U.S. Cl. ..... 206/106; 220/347; 229/9; 229/19

[58] Field of Search ..... 206/104–119; 220/347; 229/9, 19

[56] References Cited

U.S. PATENT DOCUMENTS

| | | | |
|---|---|---|---|
| 1,724,712 | 8/1929 | Hough | 206/105 |
| 2,309,965 | 2/1943 | Lee | 206/105 |
| 2,653,705 | 9/1953 | Hall | 206/118 |
| 3,888,350 | 6/1975 | Horvath | 220/347 |

*Primary Examiner*—William Price
*Assistant Examiner*—Douglas B. Farrow

[57] ABSTRACT

A safety match box comprises a cover member of a generally box-like configuration open at opposite ends and a slidable tray having a pack of matches fastened thereto which fits within the cover member. The tray comprises an open receptacle having four side walls and a base. One of the side walls which is initially inserted into the cover member is of a particular striker material. The other side wall opposite the striker comprises a segmented wall member which flexes upon the application of force to the adjacent side wall members so that the tray may be moved within the cover member. The side walls also include lug members which engage corresponding lugs in the cover member to prevent removal of the tray. The striker is exposed only upon full closure of the box for safety purposes and it is extremely difficult to a young child to open the match box. In a second embodiment, the base of the cover includes a plurality of holes at the forward end and a cut off portion at the other end for pushing the box open. The bottom of the tray includes a plurality of locking wedges at one end designed to engage the holes in the cover when the box is open and prevent the tray from being completey removed from the cover. A locking wedge at the opposite end of the tray engages one of the holes and prevents opening of the match box unless pressure is exerted on the side portions of the cover which flex so that the wedge clears one of the locking holes. The striker is at the forward end of the tray and is only exposed when the tray is completely inserted within the cover.

7 Claims, 4 Drawing Figures

SAFETY MATCH BOX

BACKGROUND OF THE INVENTION

This invention relates to a match box and particularly to a new and improved safety match box.

The prior art discloses various match box arrangements with safety features, but in general, the match boxes of the prior art fail to meet the proposed requirements of the Consumer Product Safety Commission. The Commission is endeavoring to reduce match-related injuries that in 1975 sent approximately 10,000 individuals to hospital emergency rooms according to published statistics. One of the main requirements of the Commission is to design a child-proof match box arrangement since the prior art is noticably deficient in this respect.

Typical examples of prior art arrangements include U.S. Pat. No. 2,758,708 to D.E. Reed which discloses a match box with stick type matches having a latch to prevent the same from being opened unless the latch is operated properly. When the latch is moved so that the box can be opened, the striking surfaces are not reachable so that the box has to be closed and the latch locked before a match may be struck against the abrasive striking surface.

U.S. Pat. No. 1,236,758 to Perera and U.S. Pat. No. 2,604,980 to Reed disclose match boxes having a safety striking surface which is only usable when the container is closed. These latter patents, have serious design drawbacks since for example, the tray can be removed in Perera leaving the striking surface exposed at all times while Reed does not have child-proof locking means and merely provides a minimum of safety precautions.

U.S. Pat. No. 956,092 to Hiering et al. is of general interest and discloses a match box having a pivoted cover which is opened only when a certain portion of the design is removed to release the latch.

In the general field of safety containers, not specifically match boxes, U.S. Pat. No. 3,907,103 to Shaw discloses a safety container provided with a hinged lid and latches that are released by squeezing the walls of the container. Further, U.S. Pat. No. 3,942,630 to Phillips discloses a sliding container package having locking lugs which are locked when the cover is closed and prevents the same from being opened until axial movement of the cover occurs with respect to the container against the biasing member.

The present invention, however, is a child-proof safety match box arrangement particularly suited for pocket type match books and incorporates features never utilized in the match box art. The match box of the present invention requires particular manipulation before the container can be opened and means to retain the tray within the container so that it cannot be removed. Furthermore, the striker is exposed on the end only when the box is closed. The overall combination of these features is nowhere disclosed in the prior art cited above which appears to be representative of the general art in this area although it is not intended to be an all-inclusive listing of pertinent prior art patents.

SUMMARY OF THE INVENTION

The present invention pertains to an improved safety match box, particularly for pocket type matches.

The invention comprises a cover having a substantially rectangular cross section which is opened at both ends so that a tray is slidable therein. The cover also includes a cutaway portion along the height at one end so that the tray can be gripped for sliding movement and locking lugs which insure that the tray is not removed from the container as they engage cooperating protruding members on the tray. The tray includes a base and four vertical walls with conventional pocket matches fastened therein at one end. The wall at one end of the tray as well as the connecting portion of the two adjoining walls is segmented for purposes of flexibility so that the tray can be gripped by the adjoining walls and squeezed permitting the tray to clear the locking lugs of the container and be withdrawn so that the matches are accessible. The opposite wall of the tray comprises a striker which is only accessible when the box is closed.

In a second embodiment, the cover comprises a hollow container member having a plurality of holes in the base thereof and a cutout section at the other end of said base for pushing open the tray. The tray comprises a base having pocket type matches fastened therein, a plurality of locking lugs which engage the holes in the cover so that the tray cannot be completely withdrawn and a locking wedge at the opposite end thereof so that the tray is locked in the cover when not in use. The width of the cover is somewhat greater than that of the tray and the cover is somewhat flexible so that in order to open the tray, the cover is squeezed at its opposite ends and the tray is pushed on the cutout portion thereby lifting the locking wedge out of the hold and permitting the tray to be partially withdrawn.

Accordingly, an object of this invention is to provide a new and improved safety match box arrangement.

Another object of this invention is to provide a child-proof safety match box wherein the tray cannot be completely withdrawn from the cover and particular manipulative steps must be taken in order to open the container.

A more specific object of this invention is to provide a new and improved safety type match box wherein the striker is exposed only when the box is closed, means are provided to lock the tray within the cover and the match box may be opened only upon following specific steps.

BRIEF DESCRIPTION OF THE DRAWINGS

Other objects and advantages may be seen from the following description when viewed in conjunction with the accompanying drawings wherein.

DETAILED DESCRIPTION OF THE INVENTION

Figure 1:
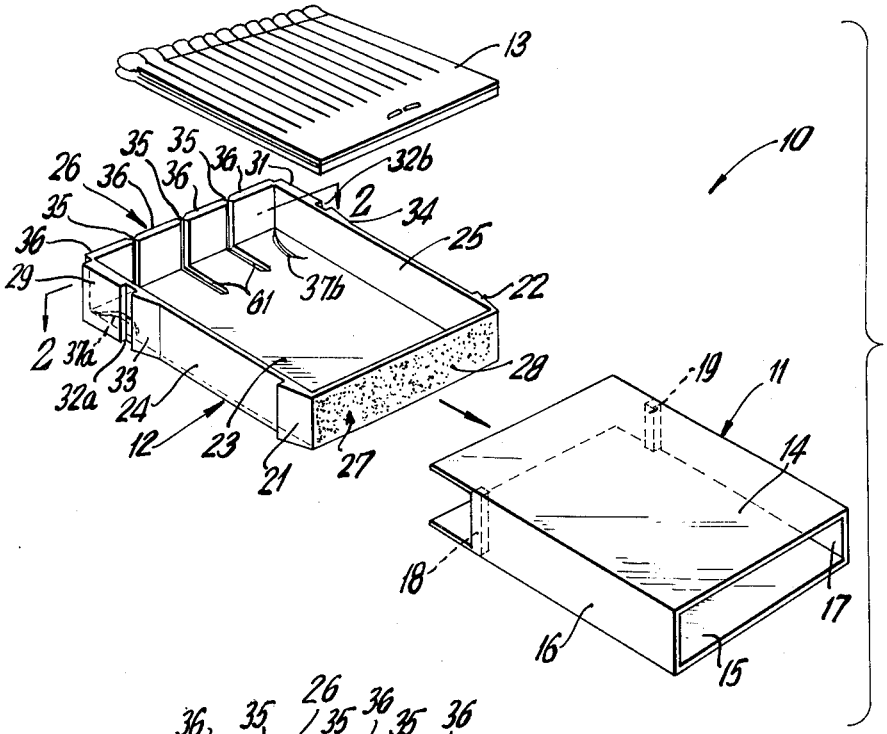
FIG. 1 is an exploded perspective view of the first embodiment of the invention.
Figure 2:
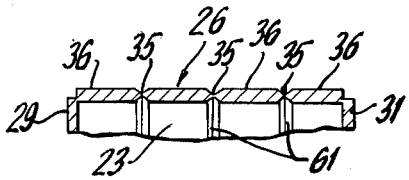
FIG. 2 is a view taken along the lines 2—2 of FIG. 1.

Referring now to FIGS. 1 and 2 of the drawings, the match box 10 of the present invention comprises a hollow cover 11 and a tray 12 which is slidable therein and contains a plurality of conventional pocket matches 13. The cover 11 is substantially rectangular in cross section and comprises upper and lower surfaces 14 and 15 respectively, and side walls 16 and 17 which join the upper and lower surfaces 14 and 15 together to form a hollow container. The side walls 16 and 17 are somewhat shorter than the length of the upper and lower surfaces 14 and 15 which project outwardly therefrom by a predetermined amount at the entry end of the tray 12. The side walls 16 and 17 each include vertical protruding lugs 18 and 19 which cooperate with projecting portions 21 and 22 on the tray 12 and thus prevent the tray 12 from being withdrawn from the cover 11.

The tray 12 comprises a base 23 and opposite pairs of walls 24, 25, and 26, 27 which form a recessed container for the matches 13. All of the aforementioned walls 24–27 are designed to fit within the cover 11 and are dimensioned accordingly. The forward wall 27 is coated with an abrasive material 28 and comprises the striker for the match box 10. The forward portion of the walls 24 and 25 each include projecting portions 21 and 22 which taper outwardly from the striker wall 27. The other end of the walls 24 and 25 each include an overlapping portion 29 and 31 of the segmented end wall 26. Spaced a predetermined distance from the overlapping wall portions 29 and 31 are respective projections 33 and 34 which taper inwardly towards the protruding walls 24 or 25 forming recesses 32*a* and 32*b*.

The end wall 26 comprises a segmented flexible wall having narrowed portions 35 forming a plurality of vertical segments 36. The base 23 also contains thinned out sections 61 at the wall 26 which join the outer portions 35 and extend a predetermined short distance along the base 23. The base 23 further includes arcuate thinned out sections 37*a* and 37*b* adjacent the forward portions of the walls 24 and 25.

In operation, the tray 12 is gripped by the overlapping portions 29 and 31 and squeezed inwardly releasing the lugs 18 and 19 from the recesses 32*a* and 32*b* so that the tray 12 may be pulled outwardly therefrom. If the proper manipulative approach is not used, the tray 12 may not be removed from the cover 11 and hence, the match box 10 requires specific skill or knowledge in order to open.

The tray 12 may not be withdrawn completely from the container or cover 11 since the projecting portions 21 and 22 engage the lugs 18 and 19 locking the tray 12 within the cover 11. As an added safety feature, the matches 13 may not be struck unless the tray 12 is completely inserted within the cover 11 so that the striker 27 is exposed.

Figure 3:
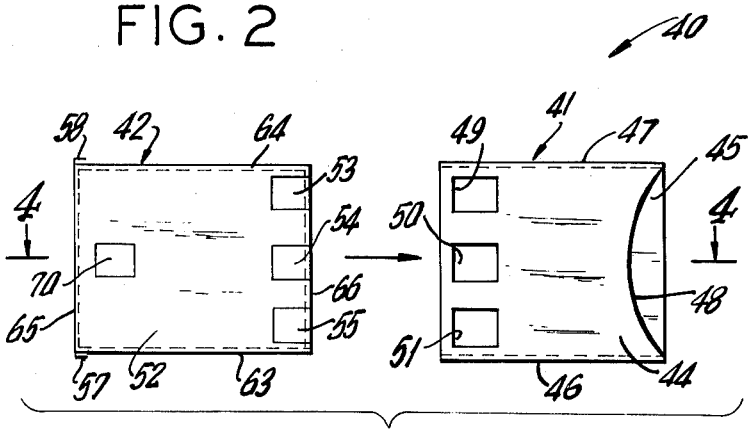
FIG. 3 is an exploded view of the second embodiment of the invention, and, FIG. 4 is a view taken along lines 4—4 of FIG. 3.
Figure 4:
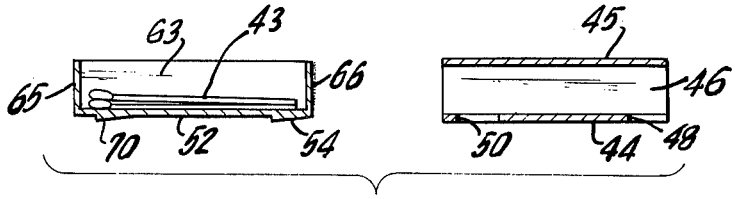

The second embodiment of the invention is illustrated in FIGS. 3 and 4 and comprises a safety match box 40 including a cover 41 and tray 42 which is slidable therein and contains pocket type matches 43 mounted therein. The cover 41 is essentially rectangular in cross section and comprises upper and lower surfaces 44 and 45 joined by side walls 46 and 47 respectively. The lower surface 44 includes a cutout arcuate portion 48 at one end and a plurality of spaced holes 49, 50 and 51 at the other end. The holes 49, 50 and 51 are designed to engage locking protrusions 53, 54 and 55 respectively in the base 52 of the tray 42 so that the tray 42 cannot be completely removed from the cover 41.

The tray 42 comprises a base 52, side walls 63 and 64 and walls 65 and 66 joined thereto in order to form a recessed container for the matches 43. The tray 42 also includes lugs 57 and 58 at the rear side walls to prevent the tray from being pushed through the cover 41 in a forward direction and a locking wedge 70 in the rear portion of the base 52 to engage the hole 50 normally locking the match box 40.

The cover 41 is somewhat wider than the tray 42 with the upper and lower surfaces 44 and 45 being of a flexible nature so that in order to withdraw the tray 42 from the cover 41, the side walls 46 and 47 are simultaneously squeezed and the tray 42 pushed from one end against the rear wall 66 facilitated by the cutout portion 48. When the cover 41 is squeezed, the locking wedge 70 is retracted from the hole 50 so that the tray is slidable within the cover 41. The tray 42 may be withdrawn until the lugs or projections 53–55 engage the holes 49–51. As an added feature, the striker on the wall 66 is not accessible unless the tray 42 is fully inserted.

While the invention has been explained by a detailed description of certain specific embodiments, it is understood that various modifications and substitutions can be made in any of them within the scope of the appended claims which are intended also to include equivalents of such embodiments.

What is claimed is:

1. A safety match box comprising:

a cover having upper and lower surfaces and side walls joining said surfaces, said side walls being recessed at one end from the edge of the upper and lower surfaces, and having locking means protruding inwardly at said ends, and, a tray which is slideable within the cover comprising a base and connecting side walls and end walls joined thereto forming a recessed container wherein one of said end walls comprises a striker and the opposite end wall comprises a segmented flexible wall to permit withdrawal from the locking means to permit movement of the tray, and wherein the side walls each include a recessed portion normally engaged by the locking means when the tray is in a closed condition and a protruding portion adjacent the striker end to engage the locking means and prevent the tray from being completely withdrawn from the cover.

2. A safety match box in accordance with claim 1 wherein:

the side walls of the tray each include tapered means at one end adjacent the striker projecting outwardly therefrom to engage the locking means and prevent withdrawal of the tray from the container.

3. A safety match box in accordance with claim 2 wherein:

the forward portions of the tray side walls each include an overlapping portion of the segmented end wall at the recessed portion of the side walls of the cover and a locking wedge spaced therefrom and tapered towards the rear of the tray to form a recess therebetween, said recess being normally engaged by the locking means when the tray is inserted within the cover.

4. A safety match box in accordance with claim 2 wherein:

the segmented end wall includes thinned out portions at predetermined intervals along the wall and the base further includes thinned out portions extending inwardly for a predetermined distance from the thinned out sections and, an arcuate thinned out portion near the ends thereof to facilitate flexing of the tray.

5. A safety match box in accordance with claim 2 further including:

a plurality of pocket matches mounted to the base of the tray adjacent the striker.

6. A safety match box comprising:

a cover comprising upper and lower surfaces joined by side walls, said lower portion having a plurality of spaced apertures at the forward portion of the base and a cutout portion at the other end, to facilitate pushing of the tray, a tray having a plurality of locking wedges at one end designed to engage the cover apertures when the tray is withdrawn from the cover, and a central locking wedge designed to engage one of said holes when the tray is inserted therein, said tray having a striker wall at one end, side walls and a forward wall at the other end and said tray being of somewhat lesser width than the cover so that the cover may be flexed by gripping at the side walls under pressure thereby removing the locking wedge from the hole to permit movement of the tray.

7. A safety match box in accordance with claim 6 wherein:

the tray further includes lugs at the rear portion of the side walls of said tray to prevent tray from being pushed through the cover in the forward direction.

* * * * *